US007845635B2

(12) United States Patent
Herrmann

(10) Patent No.: US 7,845,635 B2
(45) Date of Patent: Dec. 7, 2010

(54) TRANSLATING REGISTRATION NIP SYSTEMS FOR DIFFERENT WIDTH MEDIA SHEETS

(75) Inventor: Douglas K. Herrmann, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 227 days.

(21) Appl. No.: 12/273,991

(22) Filed: Nov. 19, 2008

(65) Prior Publication Data

US 2010/0123284 A1 May 20, 2010

(51) Int. Cl.
*B65H 7/02* (2006.01)

(52) U.S. Cl. ..... 271/228; 271/227; 271/226

(58) Field of Classification Search ..... 271/226, 271/227, 254, 228
See application file for complete search history.

(56) References Cited

U.S. PATENT DOCUMENTS

| | | | | |
|---|---|---|---|---|
| 4,334,759 | A * | 6/1982 | Clausing | 399/394 |
| 6,059,285 | A * | 5/2000 | Suga et al. | 271/228 |
| 6,173,952 | B1 * | 1/2001 | Richards et al. | 271/228 |
| 6,373,042 | B1 | 4/2002 | Kretschmann et al. | |
| 6,511,239 | B1 | 1/2003 | Kretschmann et al. | |
| 6,533,268 | B2 * | 3/2003 | Williams et al. | 271/228 |
| 6,836,627 | B2 | 12/2004 | Kretschmann et al. | |
| 6,920,307 | B2 * | 7/2005 | Howe | 399/395 |
| 7,469,894 | B2 * | 12/2008 | Seto | 271/238 |
| 7,722,035 | B2 * | 5/2010 | Pasuch et al. | 271/228 |
| 2003/0146567 | A1 * | 8/2003 | Williams et al. | 271/249 |
| 2004/0065994 | A1 | 4/2004 | Halvonik et al. | |
| 2007/0048054 | A1 | 3/2007 | De Jong et al. | |
| 2007/0062351 | A1 * | 3/2007 | Iguchi | 83/13 |
| 2007/0145667 | A1 * | 6/2007 | Pasuch et al. | 271/37 |
| 2008/0061499 | A1 | 3/2008 | De Gruchy et al. | |
| 2008/0240820 | A1 | 10/2008 | De Jong et al. | |

* cited by examiner

*Primary Examiner*—Stefanos Karmis
*Assistant Examiner*—Howard Sanders
(74) *Attorney, Agent, or Firm*—Gibb I.P. Law Firm, LLC

(57) ABSTRACT

Methods and systems feed media sheets along a media path within an apparatus in a media path direction from a media source to a destination and align the media sheets as the media sheets travel along the media path using a media alignment unit. The methods and systems move the media alignment unit in a direction perpendicular to the media path direction using movable supports to position the media alignment unit at a location equidistant from sheet width edges of the media sheets.

17 Claims, 4 Drawing Sheets

TRANSLATING REGISTRATION NIP SYSTEMS FOR DIFFERENT WIDTH MEDIA SHEETS

BACKGROUND AND SUMMARY

Embodiments herein generally relate to electrostatographic printers and copiers or reproduction machines, and more particularly, concerns a sheet registration unit that moves relative to the media path (translates) in a direction perpendicular to the media path direction as the media width changes to center the media alignment unit with respect to the media sheets.

To handle different media widths, conventional registrations systems sometimes utilize two, three, or more nips that are selectively opened and closed to accommodate different paper widths. For example, U.S. Patent 2004/0065994 (the complete disclosure of which is incorporated herein by reference) discusses common multi-nip registration systems. While many registration systems use two nips, some products that are directed to large sheets use three or more nips to reduce the loads when large sheets are registered. The embodiments described herein are useful with edge registered systems (where one edge of the media sheets is always at the same location, regardless of width of the media sheets) because, in such systems, the center line varies from the edge as the sheet width changes. In a center registered system the sheet is centered to the registration system (unless the upstream subsystems are edge registered).

Thus, some current printer devices use nip registration systems that can have two, three, or more nips. The three nips provide different nip stance offsets depending on the paper cross process size. Specifically, the two outside nips are used for the large sheets and one outside nip and the center nip together are used for the small sheets.

Embodiments herein provide an apparatus that includes a controller and a media path operatively connected to the controller. The media path feeds media sheets in a media path direction from a media source (e.g., paper tray) to a destination (e.g., a marking device placing marking on the media sheets).

A media alignment unit (registration unit) is positioned along the media path and is operatively connected to the controller. In some embodiments, the media alignment unit can comprise only two nips. In media alignments units, the nips operate at different speeds to align the sheet width edges of the media sheets to be parallel to the media path direction as the media sheets travel along the media path. A sheet width sensor can be operatively connected to the controller. Such a sheet width sensor determines the distance between the sheet width edges of the media sheets and the lateral position of the sheets.

Embodiments herein include movable supports that are connected to the media alignment unit. The movable supports are also operatively connected to the controller. The movable supports comprise actuators that operatively connect to the controller and the actuators are controlled by the controller.

The movable supports move the media alignment unit relative to the media path in a direction perpendicular to the media path direction under control of the controller. This movement centers the media alignment unit with respect to the media sheets. Therefore, the movable supports position the media alignment unit at a location equidistant from the sheet width edges of the media sheets. Thus, the movable supports move the media alignment unit so as to center the media alignment unit along a centerline of the media sheets. The centerline is positioned equidistant between the sheet width edges of the media sheets. Further, the movable supports move the media alignment unit to different positions depending upon the distance between the sheet width edges for different width media sheets and the lateral position of the sheets on the media path.

Stated in terms of a method, the embodiments herein feed media sheets along a media path within an apparatus in a media path direction from a media source to a destination and align the media sheets as the media sheets travel along the media path using a media alignment unit. The embodiments move the media alignment unit in a direction perpendicular to the media path direction using movable supports to position the media alignment unit at a location equidistant from sheet width edges of the media sheets.

As mentioned above, the movable supports can comprise actuators and the moving of the media alignment unit comprises operating such actuators. The moving of the media alignment unit is performed so as to center the media alignment unit along the centerline of the media sheets. The moving of the media alignment unit moves the media alignment unit to different positions depending upon the distance between the sheet width edges for different width media sheets. Once the media sheets are moved to the marking device, the method can place marking on the media sheets using the marking device.

These and other features are described in, or are apparent from, the following detailed description.

BRIEF DESCRIPTION OF THE DRAWINGS

Various exemplary embodiments of systems and methods are described in detail below, with reference to the attached drawing figures, in which.

DETAILED DESCRIPTION

As mentioned above, current printer devices use nip registration systems that can have three or more nips to accommodate different paper widths. However, nip registration systems with three or more nips are more expensive, heavier, and more complex than nip registration systems that use only two nips. A two nip system is desirable due to its simplicity. Further, a two nip drive is less expensive to produce, is less complicated, weighs less and takes up less space within the registration sub system than a three nip system. Therefore, it would be advantageous to only include two nips within the nip registration system.

However, one problem with two nip registration systems is that the spacing between and positioning of the two nips is a compromise between registration effectiveness for relatively wide sheets and relatively narrow sheets. For example, if the spacing and positioning of the two nips is optimized for handling more narrow sheets, such spacing and positioning would adversely affect large sheet registration. This is especially true for an edge registered system or if the sheet is far off of center in a centered registered system. This is caused because if the nips were positioned close together to accommodate more narrow sheets, the pair of nips would be offset to one side of the sheet, which would place an unbalanced, off-center load upon wider sheets. To the contrary, if the nips are spaced further apart, both may not simultaneously contact the more narrow sheets. Thus, both the inertia of the sheet and the frictional forces on the sheet act through the centerline or center of gravity (CG) of the sheet which is offset by the distance to the registration nips.

In order to address such issues, embodiments herein provide a sheet registration unit (carriage) that moves relative to the media path (translates) in a direction perpendicular to the media path direction, as the media with changes, to center the media alignment unit with respect to the media sheets. By centering the registration carriage, the embodiments herein can use a two nip system in place of the current three nip system. This simplifies the design and improves registration performance across the larger sheet sizes.

The two nip registration system can be moved to be centered in the path during, for example, the inter-document gap. Thus, after the previous paper trail edge leaves the nip and during the inter-document gap, the registration carriage centers itself to the incoming sheet based on the paper's cross process dimension (width). The registration carriage then moves to take out any lateral registration error in the sheet. The registration carriage moves back to the target center of the next incoming sheet. Again, the location of the center of the incoming sheet depends on the sheet cross process dimension.

Figure 1:
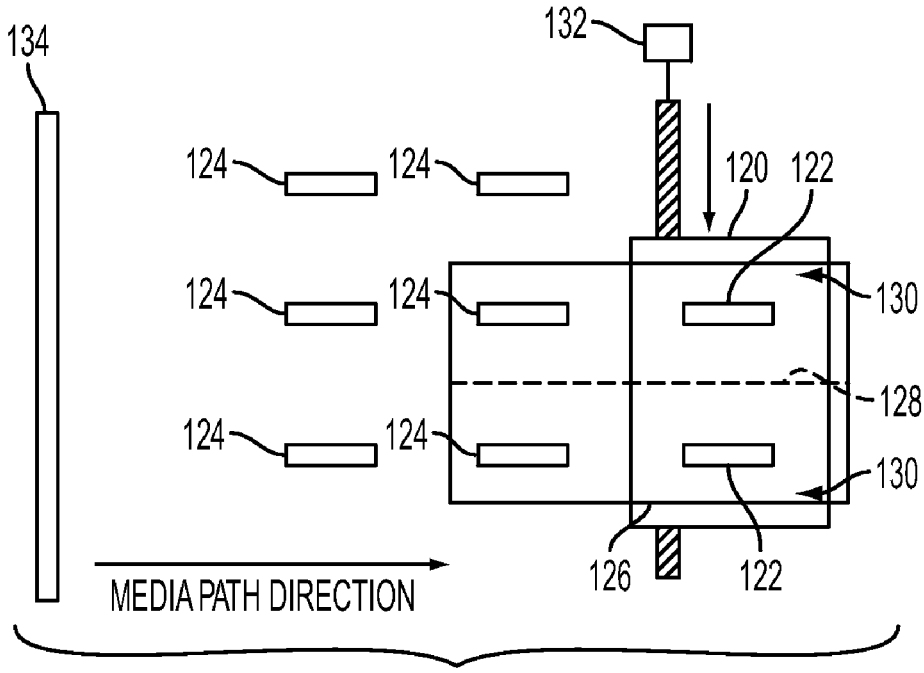
FIG. 1 is a schematic diagram of a sheet registration apparatus according to embodiments herein.
Figure 2:
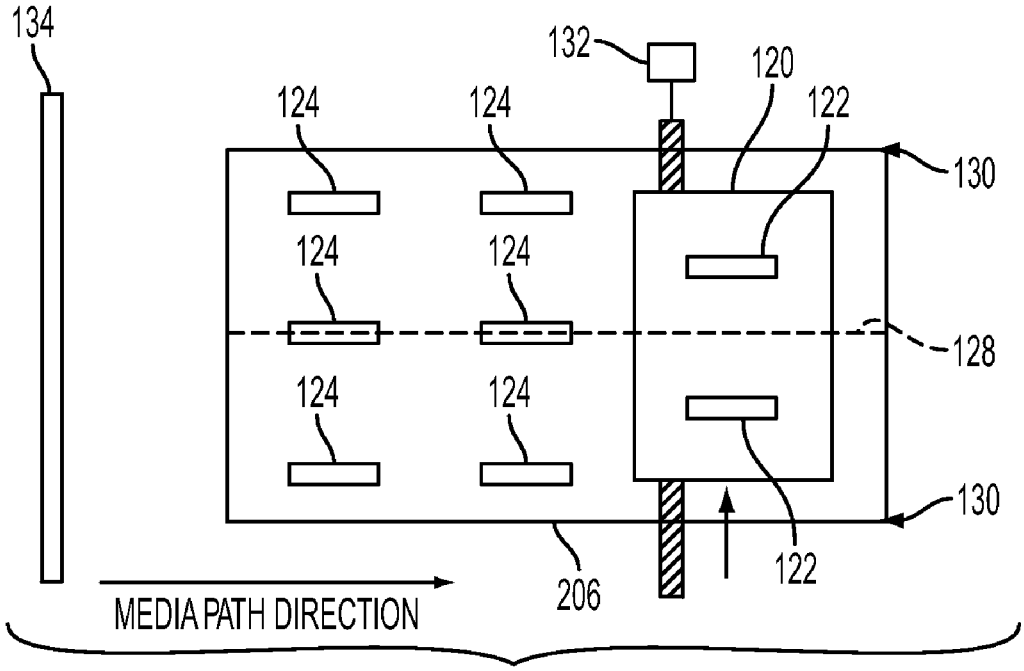
FIG. 2 is a schematic diagram of a sheet registration apparatus according to embodiments herein.
Figure 3:
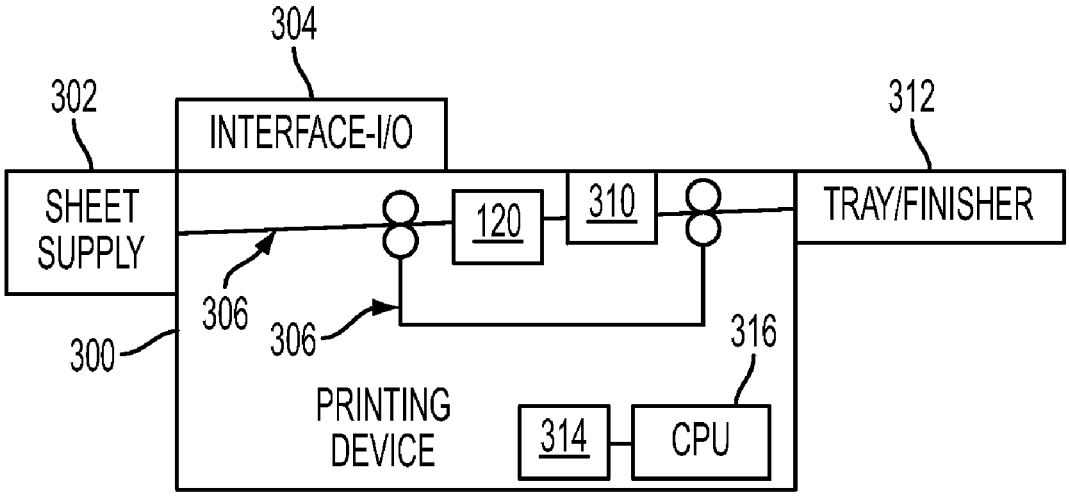
FIG. 3 is a schematic diagram of a printing apparatus according to embodiments herein.

FIGS. 1-3 illustrate exemplary structures of embodiments herein. FIGS. 1 and 2 illustrate the registration unit 120 and FIG. 3 illustrates a printer, copier, or other printing apparatus 300 that includes the registration unit 120. A more detailed discussion of an electrostatic printer is included below in the discussion of FIG. 6.

As shown generally in FIG. 3, the printing apparatus 300 includes a processor 316 within the printing apparatus 300. The apparatus 300 also includes a computer-readable storage medium 314 operatively connected to the processor 316. The computer-readable storage medium 314 stores instructions executable by the processor 316 to allow the processor 316 to control the apparatus 300 operations and perform the carriage movement discussed herein.

Further, the apparatus 300 includes at least one interface and/or input/output 304 operatively connected to the processor 316. The input/output 304 can comprise a wired or wireless Internet connection, a graphic user interface, a document input tray, a raster image scanner, or any other form of data input/output.

One or more printing engine(s) 310 can be included within the apparatus 300 to print the print job. For example, sheets can be supplied from a sheet supply 302 and be fed along a paper path 306 through the registration unit 120 to the printing engine(s) 310 to place markings on the sheets. The sheets can then be returned along the paper path 306 for additional printing (multi-color or simplex/duplex). Finally, the sheets are output to some form of user accessible region such as an output tray, sorter, finisher 312, etc.

The media path 306 is operatively connected and controlled by the controller 316. The media path 306 feeds media sheets in a media path direction from a media source 302 (e.g., paper tray) to a destination (e.g., a marking device placing marking on the media sheets 310 or tray/finisher 312). The media alignment unit (registration unit) 120 is positioned along the media path 306 and is operatively connected to the controller 316.

In some embodiments, the media alignment unit 120 can comprise only two nips 122, as is illustrated in FIGS. 1 and 2. Nips 124 are standard, fixed position (dimension between the inboard and outboard drive roller) drive nips and a printing apparatus can include more or less than the drive nips 124 shown in the drawings. In media alignment units, the nips operate at different speeds to align the sheet width edges 130 of the media sheets to be parallel to the media path direction as the media sheets travel along the media path 306. FIG. 1 illustrates a relatively narrow sheet 126 and FIG. 2 illustrates a relatively wider sheet 206.

The details of media registration units and are conventionally known. For example, U.S. Pat. Nos. 6,817,609 and 6,173,952; and U.S. Patent Publication 2008/0061499 (the complete disclosure of which is incorporated herein by reference) disclose two and three nip registration units.

A sheet width sensor 134 can be operatively connected to the controller 316. Such a sheet width sensor 134 determines the distance between the sheet width edges 130 of the media sheets 126, 206 and the lateral position of the sheets 126, 206 within the media path 306. Many common sensors are known. For example, U.S. Patent Publication 2008/0240820 (the complete disclosure of which is incorporated herein by reference) discloses a method and apparatus for determining the lateral position of a moving sheet in a sheet registration system. The position of the side edge is used along with skew of the sheet to determine the lateral position of the sheet. Other patents showing lateral edge sensors include U.S. Pat. Nos. 6,373,042; 6,511,239; and 6,836,627. The disclosure of each of these patents is incorporated herein by reference in its entirety.

Embodiments herein include movable supports 132 that are connected to the media alignment unit 120. The movable supports 132 can comprise one or more pneumatic actuators, hydraulic actuators, piston-based actuators, electric actuators, gear or screw-based actuators, etc. The movable supports 132 are also operatively connected to the controller 316 and are controlled by the controller 316. Not all operative (e.g., electrical wiring) connections are illustrated in the drawings to avoid clutter in the drawings.

As shown by the contrast between FIGS. 1 and 2, the movable supports 132 move the media alignment unit 120 relative to the media path 306 in a direction perpendicular to the media path direction (shown by the arrows in the drawings) under control of the controller 316. This movement centers the media alignment unit 120 with respect to the media sheets 126, 206. Therefore, the movable supports 132 position the media alignment unit 120 at a location equidistant from the sheet width edges 130 of the media sheets 126, 206. Thus, the movable supports 132 move the media alignment unit 120 so as to center the media alignment unit 120 along a centerline 128 of the media sheets 126, 206. The centerline 128 is positioned equidistant between the sheet width edges 130 of the media sheets 126, 206.

The movable supports 132 move the media alignment unit 120 to different positions depending upon the distance between the sheet width edges 130 for different width media sheets 126, 206. Thus, for the relatively narrow sheet 126, the media alignment unit 120 is positioned by the movable supports 132 at an offset position in the media path, while for the relatively wider sheet 206, the media alignment unit 120 is positioned by the movable supports 132 at a more centered position in the media path. While FIGS. 1 and 2 illustrate sheets within an edge registered system, the embodiments herein are also applicable to center registered sheet systems.

Figure 4:
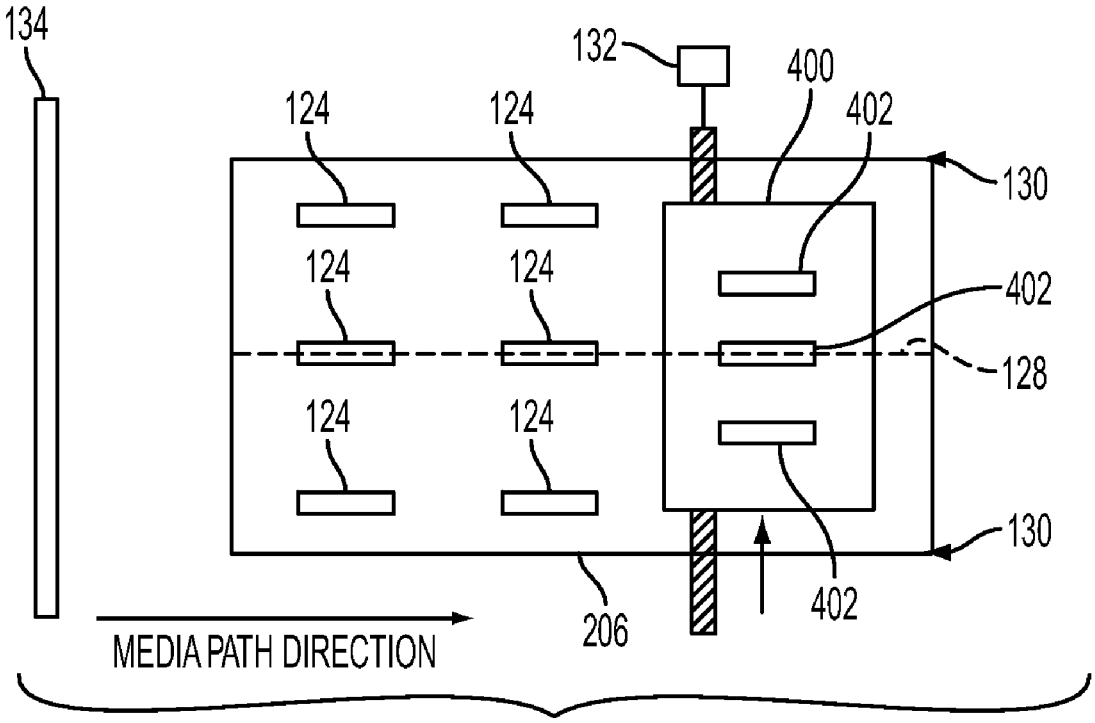
FIG. 4 is a schematic diagram of a printing apparatus according to embodiments herein.

In addition, while the above examples have included only two nips 122 in the media alignment unit 120, other embodiments can include more nips (e.g., three or more) as illustrated in FIG. 4. For example, FIG. 4 illustrates a three nip 402 media alignment unit 400. Thus, those ordinarily skilled in the art would understand that some embodiments here can use only two nips in the registration unit, while other embodiments can use three or more nips in the registration unit.

Figure 5:
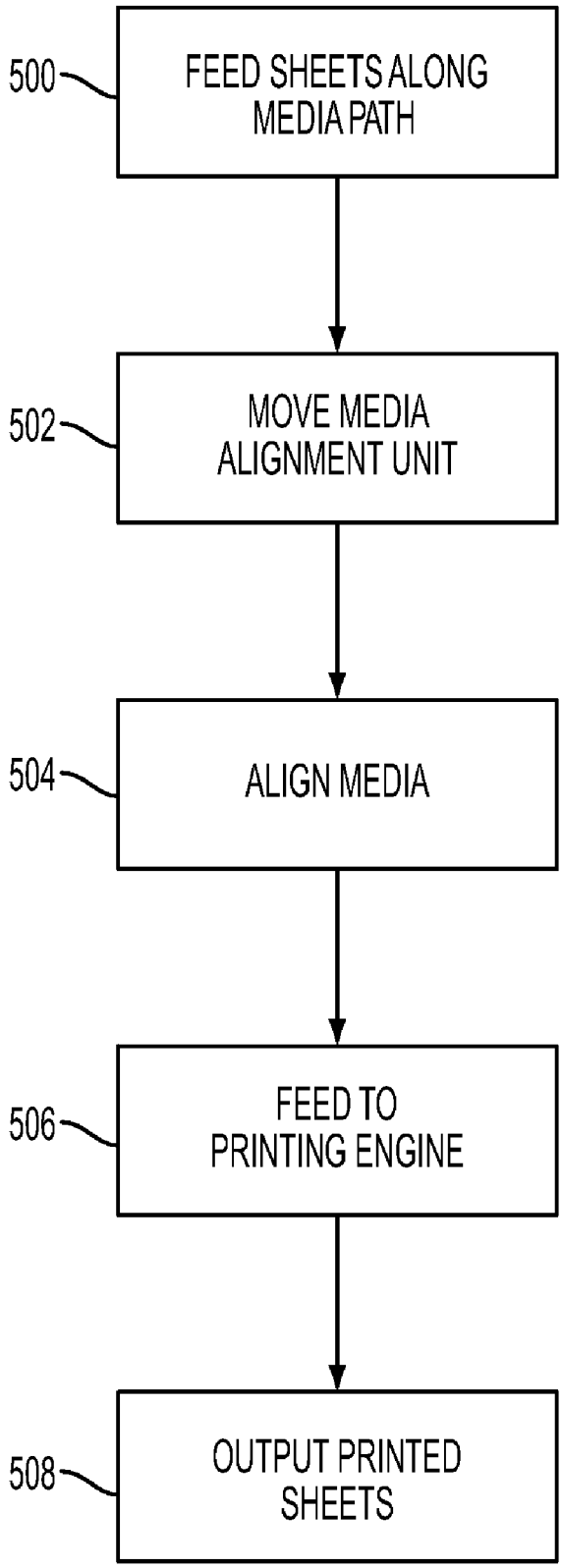
FIG. 5 is a flowchart illustrating method embodiments herein.

The embodiments herein are also illustrated in method form in FIG. 5. In item 500, the method feeds media sheets along the media path within the apparatus in the media path direction from the media source to the destination. The embodiments move the media alignment unit in a direction perpendicular to the media path direction, using movable supports, to position the media alignment unit at a location equidistant from sheet width edges of the media sheets in item 502. The method aligns the media sheets as the media sheets travel along the media path using the media alignment unit in item 504.

As mentioned above, the movable supports can comprise actuators and the moving of the media alignment unit comprises operating such actuators. The moving of the media alignment unit 502 is performed so as to center the media alignment unit along the centerline of the media sheets. The moving of the media alignment unit 502 moves the media alignment unit to different positions depending upon the distance between the sheet width edges for different width media sheets and the lateral position of the sheets within the media path. Once the media sheets are moved to the marking device 506, the method can place marking on the media sheets using the marking device 508 to produce output.

By adjusting the registration carriage from the edge of the sheet to a location more closely aligned with the center of the sheet, the forces are more evenly balanced and the moment is reduced. This allows for a smaller dimension between registration nips and eliminates the need for the conventional three nip/dual stance system for different paper sizes. The reduction in forces and moment improves registration performance and allows for a simpler, lower mass system. By moving the alignment unit to a location closer to the process center of the incoming sheet, the high moments and forces that occur when the nips are offset from the center of the sheet can be reduced or eliminated.

Thus, with embodiments herein the alignment of the registration unit to the sheet centerline balances registration forces. This allows a reduced nip stance that can accommodate smaller sheets while controlling adverse moments on large sheets during registration. This reduces complexity, cost, and inertia for the lateral registration carriage and allows for more balanced force distribution about the centerline of the sheets which reduces the forces at the nip. This produces improved registration performance by elimination of moments caused by offset nip loads in an edge registered system.

As evidenced by U.S. Patent Publication 2007/0048054 (the complete disclosure of which is incorporated herein by reference) center registered systems center the media with respect to the registration unit. U.S. Patent Publication 2007/0048054 provides a method and system whereby the media sheet is moved laterally within the sheet path so as to center the sheet with respect to a non-movable media registration unit that is in a fixed position that does not change. The embodiments herein break away from such teachings and, rather than providing efforts to laterally move the media sheet with respect to the media path, provide a registration unit that can move laterally so as to be constantly centered with respect to the width of the media sheet.

Thus, embodiments herein work well with edge registered systems because the alignment nips are able to translate to accommodate varying sheet sizes. The carriage moves into position prior to the incoming sheet to ensure that the alignment unit is centered for that sheet.

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

The word "printer" or "image output terminal" as used herein encompasses any apparatus, such as a digital copier, bookmaking machine, facsimile machine, multi-function machine, etc. which performs a print outputting function for any purpose. The embodiments herein specifically applied to electrostatic and xerographic devices. The details of printers, printing engines, etc. are well-known by those ordinarily skilled in the art and are discussed in, for example, U.S. Patent Publication 2008/0061499, the complete disclosure of which is fully incorporated herein by reference.

Figure 6:
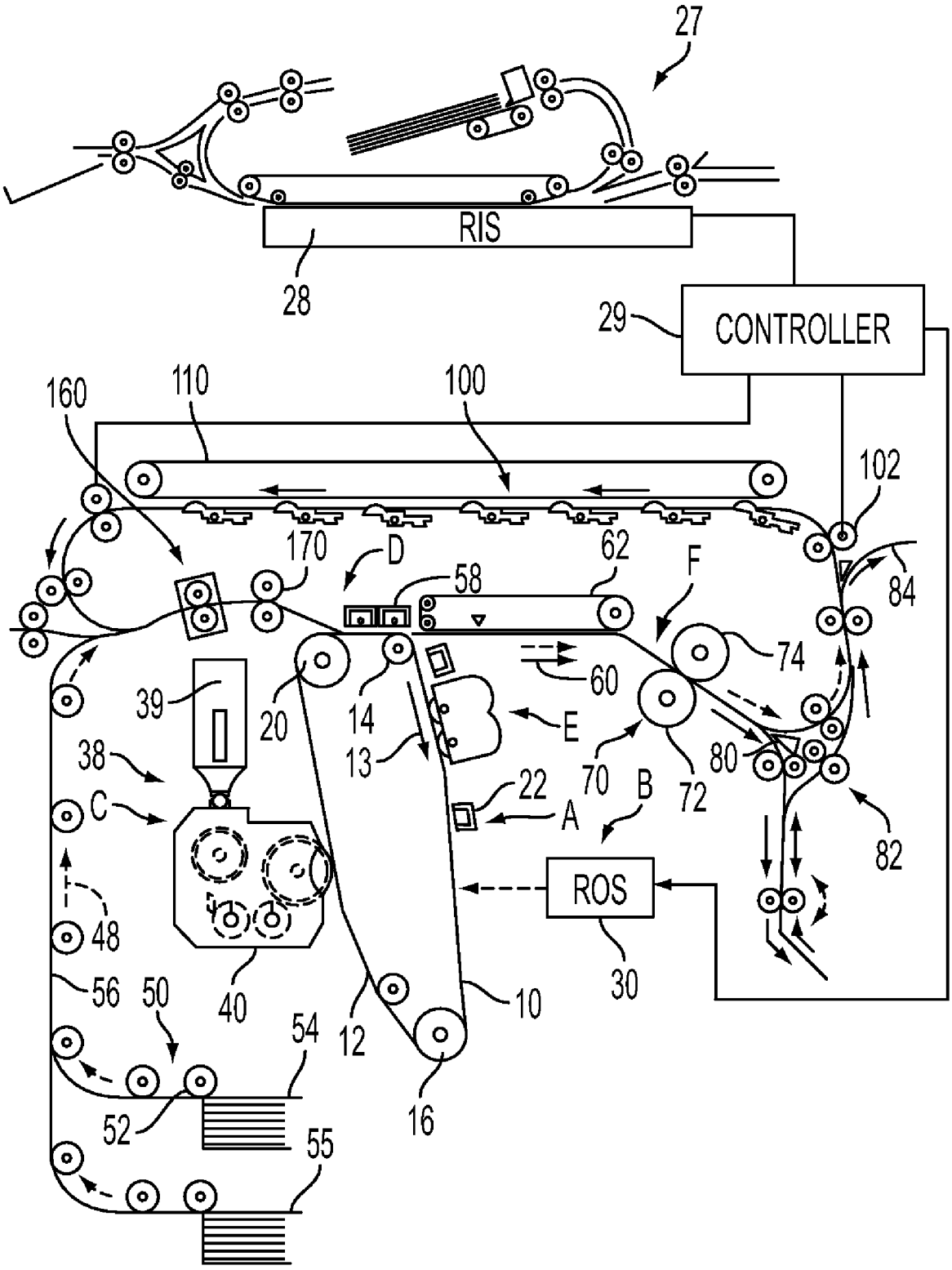
FIG. 6 is a schematic diagram of a printing apparatus according to embodiments herein.

For example, FIG. 6 schematically depicts an electrophotographic printing machine that is similar to one described in U.S. Patent Publication 2008/0061499. It will become evident from the following discussion that the present embodiments may be employed in a wide variety of devices and is not specifically limited in its application to the particular embodiment depicted in FIG. 6.

Referring to FIG. 6 schematically depicts an electrophotographic printing machine incorporating the features of the present disclosure therein. It will become evident from the following discussion that the stalled roll registration device of the present disclosure may be employed in wide variety of devices and is not specifically limited in its application to the particular embodiment depicted herein. For example, the registration apparatus of the present disclosure can be used in document handlers, if desired.

FIG. 6 illustrates an original document positioned in a document handler 27 on a raster input scanner (RIS) indicated generally by the reference numeral 28. The RIS contains document illumination lamps; optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

FIG. 6 schematically illustrates an electrophotographic printing machine, which generally employs a photoconductive belt 10. Preferably, the photoconductive belt 10 is made from a photoconductive material coated on a grounded layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 16 and drive roller 20. As roller 20 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or grayscale rendition of the image which is transmitted to a modulated output generator, for example, a raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station C, where toner, in the form of liquid or dry particles, is electrostatically attracted the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 39, dispenses toner particles into developer housing 40 of developer unit 38.

With continued reference to FIG. 6, after the electrostatic latent image is developed, the toner powder image present on belt 10 advances to transfer station D. A print sheet 48 is advanced to the transfer station D, by a sheet feeding apparatus, 50. Preferably, sheet feeding apparatus 50 includes a feed rolls 52 contacting the uppermost sheet of stacks 54 and 55, respectively. Feed roll 52 rotates to advance the uppermost sheet from stack 54 into vertical transport 56. Vertical transport 56 directs the advancing sheet 48 of support material into pre-registration device 160 which in conjunction with stalled roll registration mechanism 170 moves a now registered sheet 48 past image transfer station D to receive an image from photoreceptor belt 10 in a timed sequence so that the toner powder image formed thereon contacts the advancing sheet 48 at transfer station D. Transfer station D includes a corona generating device 58, which sprays ions onto the back side of sheet 48. This attracts the toner powder image from photoconductive surface 12 to sheet 48. After transfer, sheet 48 continues to move in the direction of arrow 60 by way of belt transport 62, which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roll 72. The pressure roller is cammed against the fuser roller to provide the necessary pressure to fix the toner powder image to the copy sheet. The fuser roll is internally heated by a quartz lamp. Release agent, stored in a reservoir, is pumped to a metering roll. A trim blade trims off the excess release agent. The agent transfers to a donor roll and then to the fuser roll 72.

The sheet then passes through fuser 70 where the image is permanently fixed or fused to the sheet. After passing through fuser 70, a gate 80 either allows the sheet to move directly via output 84 to a finisher or stacker, or deflects the sheet into the duplex path 120, specifically, first into single sheet inverter 82 here. That is, if the sheet is either a simplex sheet or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 120, where that sheet will be inverted and then fed to acceleration nip 122 and belt transports 130, for recirculation back through transfer station D and fuser 70 for receiving and permanently fixing the side two image to the backside of that duplex sheet, before it exits via exit path 84.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the non-transferred toner particles. The blade may be configured in either a wiper or doctor position depending on the application. Subsequent to cleaning, a discharge lamp floods photoconductive surface 12 with light to dissipate any residual electrostatic charge remaining thereon prior to the charging thereof for the next successive imaging cycle.

The various machine functions are regulated by controller 29. The controller is preferably a programmable microprocessor, which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein should not be implied or imported from any above example as limitations to any particular order, number, position, size, shape, angle, color, or material.

What is claimed is:

1. An apparatus comprising:

a controller;

a media path operatively connected to said controller, said media path feeding media sheets in a media path direction from a media source to a destination;

a media alignment unit positioned along said media path and operatively connected to said controller, said media alignment unit aligning said media sheets as said media sheets travel along said media path; and movable supports connected to said media alignment unit and operatively connected to said controller, said movable supports moving said media alignment unit in a direction perpendicular to said media path direction under control of said controller to position said media alignment unit at a location equidistant from sheet width edges of said media sheets, and said movable supports moving said media alignment unit to different positions depending upon said distance between said sheet width edges for different width media sheets.

2. The apparatus according to claim 1, said movable supports comprising actuators operatively connect to said controller and said actuators being controlled by said controller.

3. The apparatus according to claim 1, said movable supports moving said media alignment unit so as to center said media alignment unit along a centerline of said media sheets, said centerline being positioned equidistant between said sheet width edges of said media sheets.

4. The apparatus according to claim 1, said destination comprising a marking device placing marking on said media sheets.

5. An apparatus comprising:

a controller;

a media path operatively connected to said controller, said media path feeding media sheets in a media path direction from a media source to a destination;

a media alignment unit positioned along said media path and operatively connected to said controller, said media alignment unit comprising only two nips, said nips operating at different speeds to align sheet width edges of said media sheets to be parallel to said media path direction as said media sheets travel along said media path;

a sheet width sensor operatively connected to said controller, said sheet width sensor determining a distance between said sheet width edges of said media sheets; and movable supports connected to said media alignment unit and operatively connected to said controller, said movable supports moving said media alignment unit relative to said media path in a direction perpendicular to said media path direction under control of said controller to center said media alignment unit with respect to said media sheets and position said media alignment unit at a location equidistant from said sheet width edges of said media sheets.

6. The apparatus according to claim 5, said movable supports comprising actuators operatively connect to said controller and said actuators being controlled by said controller.

7. The apparatus according to claim 5, said movable supports moving said media alignment unit so as to center said media alignment unit along a centerline of said media sheets, said centerline being positioned equidistant between said sheet width edges of said media sheets.

8. The apparatus according to claim 5, said movable supports moving said media alignment unit to different positions depending upon said distance between said sheet width edges for different width media sheets.

9. The apparatus according to claim 5, said destination comprising a marking device placing marking on said media sheets.

10. A module installable in an apparatus having a controller and a media path operatively connected to said controller, said media path feeding media sheets in a media path direction from a media source to a destination, said module comprising:

a media alignment unit positioned along said media path and operatively connected to said controller, said media alignment unit aligning said media sheets as said media sheets travel along said media path; and movable supports connected to said media alignment unit and operatively connected to said controller, said movable supports moving said media alignment unit in a direction perpendicular to said media path direction under control of said controller to position said media alignment unit at a location equidistant from sheet width edges of said media sheets, and said movable supports moving said media alignment unit to different positions depending upon said distance between said sheet width edges for different width media sheets.

11. The module according to claim 10, said movable supports comprising actuators operatively connect to said controller and said actuators being controlled by said controller.

12. The module according to claim 10, said movable supports moving said media alignment unit so as to center said media alignment unit along a centerline of said media sheets, said centerline being positioned equidistant between said sheet width edges of said media sheets.

13. The module according to claim 10, said destination comprising a marking device placing marking on said media sheets.

14. A method comprising:

feeding media sheets along a media path within an apparatus in a media path direction from a media source to a destination;

aligning said media sheets as said media sheets travel along said media path using a media alignment unit;

moving said media alignment unit in a direction perpendicular to said media path direction using movable supports to position said media alignment unit at a location equidistant from sheet width edges of said media sheets; and moving said media alignment unit to different positions depending upon said distance between said sheet width edges for different width media sheets.

15. The method according to claim 14, said movable supports comprising actuators said moving of said media alignment unit comprising operating said actuators.

16. The method according to claim 14, said moving of said media alignment unit being performed so as to center said media alignment unit along a centerline of said media sheets, said centerline being positioned equidistant between said sheet width edges of said media sheets.

17. The method according to claim 14, said destination comprising a marking device, said method further comprising placing marking on said media sheets using said marking device.

* * * * *